US008574378B2

(12) United States Patent
Milroy

(10) Patent No.: US 8,574,378 B2
(45) Date of Patent: Nov. 5, 2013

(54) SANITIZING APPARATUS AND SYSTEM FOR HOME BREWING EQUIPMENT

(76) Inventor: Mark Milroy, Tigard, OR (US)

( * ) Notice: Subject to any disclaimer, the term of this patent is extended or adjusted under 35 U.S.C. 154(b) by 323 days.

(21) Appl. No.: 13/018,782

(22) Filed: Feb. 1, 2011

(65) Prior Publication Data

US 2011/0186084 A1 Aug. 4, 2011

Related U.S. Application Data

(60) Provisional application No. 61/300,399, filed on Feb. 1, 2010.

(51) Int. Cl.

| | |
|---|---|
| ***B08B 3/00*** | (2006.01) |
| ***B08B 9/08*** | (2006.01) |
| ***B08B 9/093*** | (2006.01) |

(52) U.S. Cl.

USPC ..... 134/169 R; 134/103.1; 134/103.2; 134/166 R; 134/168 R; 134/186; 134/22.18

(58) Field of Classification Search

USPC ..... 134/103.1, 103.2, 166 R, 169 R, 168 R, 134/186, 22.18, 198

See application file for complete search history.

(56) References Cited

U.S. PATENT DOCUMENTS 3,606,618 A * 9/1971 Veech ..... 4/603
6,782,567 B1 * 8/2004 Austin et al. ..... 4/615

FOREIGN PATENT DOCUMENTS

EP 35238 A1 * 9/1981

OTHER PUBLICATIONS

Carboy and Keg Washer, Internet publication by Sam Scott at Aleiens Homebrew Club, Oct. 18, 2009.*

BrewBoard, internet publication, Keg and Carboy Washer, Details on how to build a keg and carboy washer for $50, Aug. 29-30, 2008.*

"Keg/Carboy Washer on Carboy" uploaded by davelouw on Aug. 28, 2008; YouTube [Online] Retrieved from the Internet <URL: www.youtube.com/watch?v=t_QUbDREsXI>; visited on Jan. 19, 2011. (screen shot of 2 pages).

"Keg and Carboy Washer" uploaded by samwscott on Oct. 18, 2009; YouTube [Online] Retrieved from the Internet <URL: www.youtube.com/watch?v=9q-DHkeM1Xk>; visited Jan. 19, 2011. (screen shot of 2 pages).

"Homebrew Carboy and Keg Washer" uploaded by smkranzl on Nov. 13, 2010; YouTube [Online] Retrieved from the <URL: www.youtube.com/watch?v=mrBaLg73WIQ>; visited Jan. 19, 2011. (screen shot of 2 pages).

"HomeBrewers Outpost" [Online] Retrieved from the <URL: www.homebrewers.com/product/4794/Spray_Wand.html>; visited Jan. 19, 2011. (screen shot of 1 page).

"Carboy and Keg Washer" uploaded by Sam Scott on Oct. 18, 2009; [Online] Retrieved from the <URL: http://tiny.cc/kegwasher Carboy and Keg Washer>; visited Jan. 19, 2011. (screen shot of 13 pages).

* cited by examiner

*Primary Examiner* — Alexander Markoff
(74) *Attorney, Agent, or Firm* — Ganz Law P.C.

(57) ABSTRACT

A system, apparatus, and method for home brewing equipment including a basin for holding a cleaning solution and a support assembly mountable in the basin, the support assembly sized and configured to support a container in an upside down position and above the cleaning solution. A plumbing assembly may be coupled to the basin to receive cleaning solution from the basin and the plumbing assembly may be coupled to at least one channel configured to extend into the body of the container. The plumbing assembly may include a pump so that when the pump is activated pressurized cleaning solution is released from the channel inside the container against the inner walls of the container so that the inside of the container is sanitized. The basin may have support elements defining footprints for supporting at least two different sizes of containers.

17 Claims, 6 Drawing Sheets

SANITIZING APPARATUS AND SYSTEM FOR HOME BREWING EQUIPMENT

RELATED APPLICATIONS

This application claims priority to and the benefit of U.S. Provisional Application Ser. No. 61/300,399, filed on Feb. 1, 2010 by Mark Milroy, entitled "Sanitizing Apparatus and System for Home Brewing Equipment," the entire disclosure of which is hereby incorporated by reference as if set forth in its entirety for all purposes.

BACKGROUND

The inventive subject matter disclosed herein relates to an apparatus and system for sanitizing home brewing equipment such as large bottles and tubing. In particular, the inventive subject matter relates to an apparatus, system, and method that allows for conveniently cleaning kegs, for example a Cornelius Keg or Carboy, and tubing associated with the home brewing of fermented beverages.

Several beverages are frequently brewed at home, such as beer, wine, cider, mead, ginger ale, sake, etc. Every successful home brewer and professional brewer will tell that sanitation is the key to success. For example, making beer consists of growing yeast in a medium very favorable to micro organisms, such as malted barley. Contamination by other microorganisms must be strictly guarded against. Brewing beer involves using large containers and long hoses. Before the beer is clarified, the solution in the container and tubes will have sediments of inactive yeast and other residues. These items are particularly difficult to clean and sterilize. Currently, chemicals and chlorine bleach are used to sterilize these items. For storing home brewed beer, kegging is recommended over storing in individual bottles. Kegs are more convenient to clean and store than individual bottles, and carbonation levels can be easily adjusted in larger kegs. By far the most common system used by home brewers for draft beer is the 5-gallon soda canister, originally manufactured by the Cornelius Company (Annoka, Minn.). Though other companies also make similar models, the style is usually referred to as a Cornelius or "Corny" keg. These stainless steel canisters were developed and used to distribute premixed soda for common restaurant dispensers. The keg shape, capacity, and fittings are standardized, and over the years millions have been manufactured. Most of the component parts of Corny kegs will contact the beer, so it is extremely important that all parts be properly cleaned and sanitized before use.

Another example of a container that is often used in home brewing is a carboy. It is a glass or plastic vessel used in fermenting beverages. The carboy is a rigid container with a typical capacity of 5 to 15 gallon (19 to 57 Liter). Carboys are used for transporting fluids such as water, chemicals, etc. They are also used for in-home fermentation of beverages, often wine. In brewing, a carboy is also known as a demijohn. Usually it is fitted with a rubber stopper and a fermentation lock to prevent bacteria and oxygen from entering during the fermentation process. Polypropylene carboys are also commonly used in laboratories to transfer purified water. They are typically filled at the top and have a spigot at the bottom for dispensing.

Cleaning of these containers usually involves a tedious process of soaking, rotating, brushing, and rinsing. Some prior art cleaning equipment attaches to a faucet and allows for a nozzle to be inserted in the keg. For example, a commercially available Spray Wand sold by Homebrewers Outpost (http://www.homebrewers.com/product/4794/Spray_Wand.html). This system does not give the option of spraying the cleaning solution into the bottle and it is unwieldy to use.

Some other keg washers use a submersible pump that is positioned in a bucket. However, these keg washers do not allow direct access by the user to the cleaning solution during use and do not accommodate different sizes of containers in a single design. Moreover, these keg washers include a tubing assembly that is positioned in the bucket where it becomes submerged or drenched with fluid.

None of the existing cleaning systems provides the easy of operation, efficiency, and versatility of the inventive subject matter.

Accordingly there is a need for an apparatus and a system that makes it convenient to sanitize home brewing vessels and tubes. In addition, it provides a convenient and sterile place to temporarily store other items used in the home brewing process.

SUMMARY

The inventive subject matter overcomes problems in the prior art by providing a system, apparatus, and method for sanitizing home brewing equipment with the following qualities, alone or in combination.

In one possible embodiment, the inventive subject matter is directed to a sanitizing system for home brewing equipment, including a basin for holding a cleaning solution, a support assembly mountable in the basin, the support assembly sized and configured to support a container in an upside down position and above the cleaning solution, a plumbing assembly having at least one drain channel coupled to the basin to receive cleaning solution from the basin and at least one pressurizable channel configured to extend into the body of the container. The plumbing assembly may further have a pump interacting with the channels so that when the pump is activated pressurized cleaning solution is released from the pressurizable channel inside the container against the inner walls of the container so that the inside of the container is sanitized and the cleaning solution drains back into the basin. In the foregoing embodiment, the plumbing assembly may further have a channel branching off the pressurizable channel and adapted for cleaning home brewing accessories, such as tubes. In the foregoing embodiment, the support assembly may have a bracket adapted for supporting a bottle type container upside down by supporting the shoulders of the bottle and holding the mouth of the bottle above the cleaning solution. In the foregoing embodiment, the plumbing assembly may have at least one valve for regulating the flow of the cleaning solution through the plumbing assembly. In the foregoing embodiment, the basin may be used for storing home brewing equipment, with or without the presence of cleaning solution. In the foregoing embodiment, the support assembly may be adapted to support a container having a volume ranging between 3 and 15 gallons, for example a carboy or Cornelius keg as used for home brewing.

In another possible embodiment, the inventive subject matter is directed to an apparatus for sanitizing home brewing equipment. The apparatus may have a basin for holding a cleaning solution, a support assembly mounted in the basin and having dimensions adapted for supporting a bottle type container with the shoulders of the container resting on the support assembly and adapted to hold the container with the mouth of the container downward and above the cleaning solution, a drain channel having a first end and a second end, the first end coupled to the basin so that cleaning solution drains from the basin into the drain channel, a pump being coupled to a second end of the drain channel, a pressurizable channel having one end coupled to the pump, and a free end provided with a spray nozzle, the free end and nozzle sized to be inserted into the container. The pump pressurizes the cleaning solution into the pressurizable channel and the pressurizable channel releases the cleaning solution under pressure via the nozzle into the container so that the inside of the container is sanitized and the cleaning solution drains back into the basin. In the foregoing embodiment, the basin may be provided with legs supporting the basin and wherein the drain channel, pump, and pressurizable channel are positioned below the bottom of the basin and the pressurizable channel extends through the bottom of the basin to reach the inside of the container. In the foregoing embodiment, the pressurizable channel may branch off with a channel adapted to clean tubes used in home brewing equipment. In the foregoing embodiment, the plumbing assembly may have at least one valve for regulating the flow of the cleaning solution through the plumbing assembly.

In yet another possible embodiment, the inventive subject matter is directed to a method for cleaning home brewing equipment, the method including providing a basin with a cleaning solution, positioning a container in an upside down position and above the cleaning solution, providing a pump for pressurizing cleaning solution into a channel configured to extend into the body of the container so that when the pump is activated pressurized cleaning solution is released from the pressurizable channel against the inner walls of the container thereby sanitizing the inside of the container. Cleaning solution drains back into the basin. The basin is configured to allow direct access by the user to the cleaning solution during use of the basin while the pump is activated, and wherein the basin has support elements defining footprints for supporting at least two different sizes of containers, and wherein one footprint is within the perimeter of the other footprint. In the foregoing embodiment, the method may include providing for a support assembly that is adapted to support a container having a volume ranging between approximately 3 and 15 gallons, such as a carboy or Cornelius keg as used in home brewing.

In another possible embodiment, a basin for sanitizing containers may have a chamber to hold a solution, a raised platform sized and configured to support a container in an upside down position above the solution, the platform housing a submersible pump so that, when the pump is activated, solution enters the pump from the chamber and pressurized solution is released from the pump into a channel extending into the container so that the inside of the container will be sanitized and solution drains back into the chamber of the basin via a container opening. The chamber may be configured to allow direct access by the user to the solution during use of the basin, and the basin includes support elements defining footprints for supporting at least two different sizes of containers, and wherein one footprint is within the perimeter of the other footprint. In the foregoing embodiment, one footprint may be concentric to the other footprint. In the foregoing embodiment, the footprints may be concentric to a pump outlet channel. In the foregoing embodiment, the support elements may define a first footprint having a diameter for supporting a larger size container and within the perimeter of the first footprint support elements that define a second footprint having a diameter for supporting smaller sized containers. In the foregoing embodiment, the basin may have a first footprint for supporting different sizes of containers and further comprises a second footprint within the perimeter of the first footprint for supporting bottle type containers. In the foregoing embodiment, support elements may be configured, for example, to support a standard 7 gallon brew pail with a 14" diameter opening and 16" high and/or a standard 5 gallon pail with a 12" opening and 14" high.

The inventive subject matter further contemplates a system for sanitizing containers having a basin including an open chamber for holding a solution, a raised platform sized and configured to support a container in an upside down position and above the solution, the platform housing a submersible pump so that, when the pump is activated, solution enters the pump from the chamber and pressurized solution will be released from the pump into the container so that the inside of the container will be sanitized and solution drains back into the chamber of the basin via a container opening. The chamber may be configured to allow direct access by the user to the solution during use of the basin, and the basin includes support elements defining a first footprint for supporting at least two different sizes of containers. The system further includes a support assembly mountable within the perimeter of the first footprint, the support assembly comprising a second footprint defined by support elements for supporting a bottle type container in an upside down position and above the solution. Pressurized solution will be released from the pump into to a pressurizable channel configured to extend into the body of the container. In the foregoing embodiment, the first and second footprints may be adapted to support container having a volume ranging between 3 and 15 gallons.

The inventive subject matter also contemplates a kit including a basin, for example as described above, a support assembly, and a pressurizable channel. Some kits may also include a submersible pump.

These and other embodiments are described in more detail in the following detailed descriptions and the figures.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The following figures show embodiments according to the inventive subject matter, unless noted as showing prior art.

DETAILED DESCRIPTION

Figure 1:
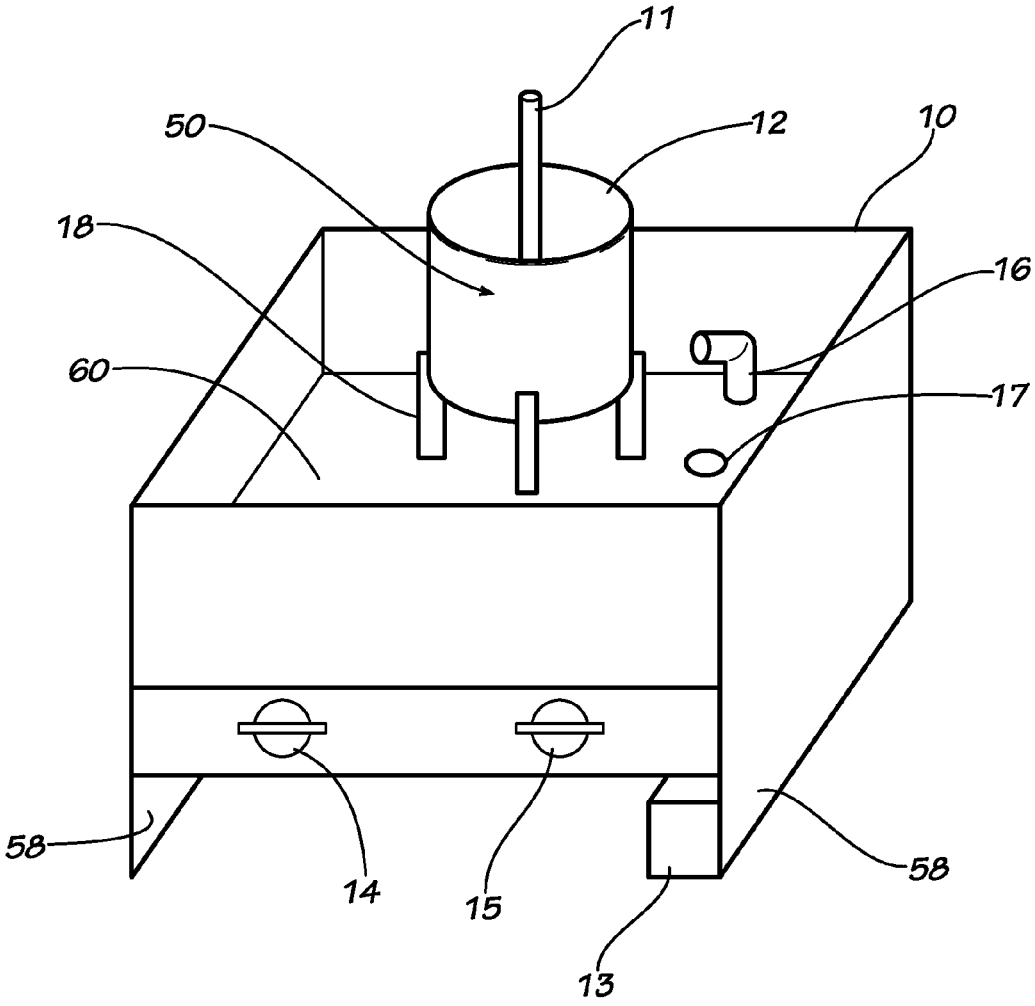
FIG. 1 is a sketch of a perspective view of an apparatus for sanitizing home brewing equipment.

Representative embodiments according to the inventive subject matter are shown in FIGS. 1-6, wherein the same or generally similar features share common reference numerals.

The inventive subject matter is directed to a system and apparatus for sanitizing home brewing equipment. The system includes a basin for holding a cleaning solution, a support assembly mountable in the basin, the support assembly sized and configured to support a container in an upside down position with its opening above the cleaning solution, and a pressurizable channel extending from a pump into the container. The "upside down" position of a container refers to a position wherein the opening of the container faces the basin. In some embodiments, the system may include a plumbing assembly having at least one drain channel coupled to the basin to receive cleaning solution from the basin and at least one pressurizable channel configured to extend into the body of the container. The plumbing assembly may further include a pump interacting with the channels so that, when the pump is activated, pressurized cleaning solution is released from the pressurizable channel inside the container against the inner walls of the container so that the inner walls of the container are sanitized and the cleaning solution drains back into the basin. Optionally, the system may further include one or more channel(s) branching off the pressurizable channel and adapted for cleaning home brewing accessories, such as tubes or connector pieces. Additionally, the system may integrate support mechanisms for at least two different sizes of containers to be supported in a single basin. For example, the basin may have support elements defining footprints for supporting at least two different sizes of containers. One footprint may be within the perimeter of the other footprint. These support elements may be adapted to support containers, such as a 7 gallon brew pail, 5 gallon container, or carboy. These containers do not fit in a regular dishwasher and may be easily sanitized by the systems according to the inventive subject matter. The figures illustrate how the system and apparatus may be used, for example, for cleaning kegs, carboys, brew pails, tubes and miscellaneous brewing items. In contrast to existing keg washing systems, the open basin design of the inventive subject matter allows easy access to the cleaning fluid while the keg washer is in use.

As used herein the term "container" refers to a rigid container for holding fluid, such as a pail or bottle. The container could be cylindrical, rectangular, or any other shape. In the case of a bottle shaped container, the container has a neck that is narrower than the body of the bottle, and a mouth at the end of the neck. Containers may be made of glass, clay, plastic, aluminum or other impervious materials, and are typically used to store liquids such as water, milk, soft drinks, beer, wine, cooking oil, medicine, shampoo, ink and chemicals.

The terms "tube" and "channel" refer to a hollow, usually cylindrical body of metal, glass, rubber, or other material, used for conveying or containing liquids or gases.

The term "plumbing assembly" refers to a system for conveying cleaning solution, water, etc., for example by channels, tubes, or pipes. The plumbing assembly may further include a pump.

The term "basin" refers to an open, shallow container such as used for holding liquids.

Figure 2:
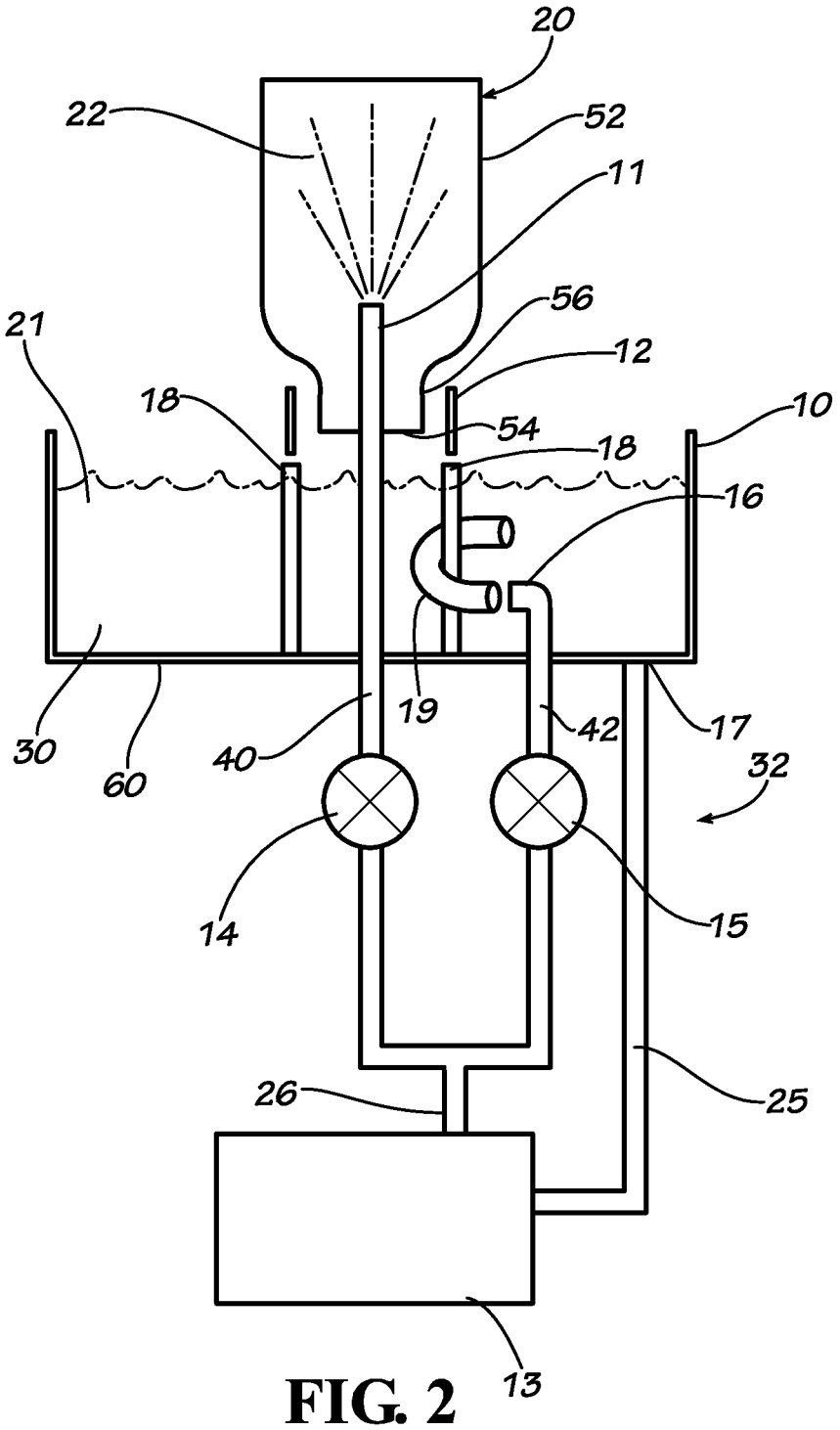
FIG. 2 is a schematic representation of a system for sanitizing home brewing equipment.
Figure 3:
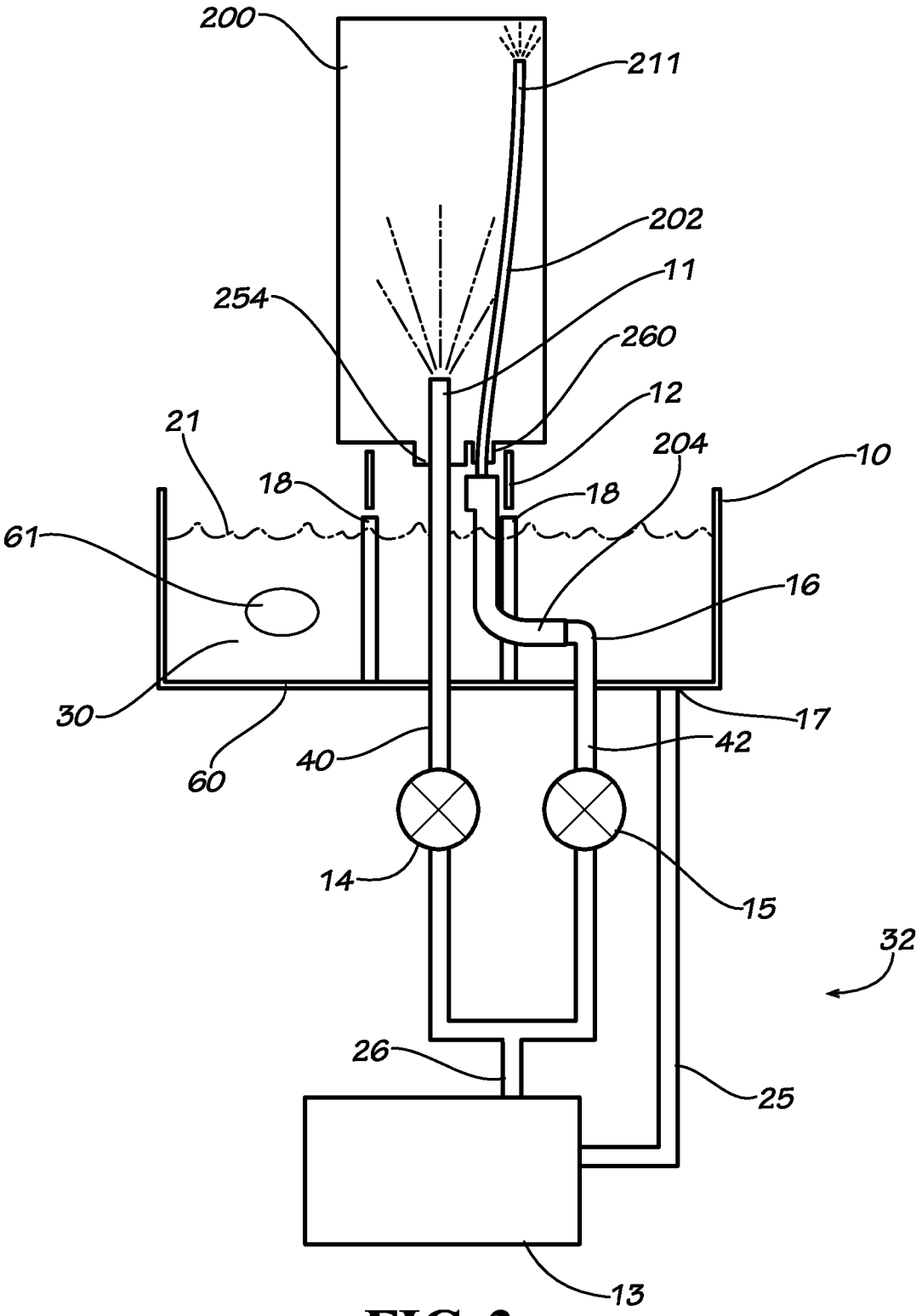
FIG. 3 is a schematic representation of another system for sanitizing home brewing equipment.

FIGS. 1-3 show a system and apparatus for cleaning the inside of a home brewing beverage container. The apparatus includes a basin 10, a drain channel 25, a pump 13, and a pressurizable channel 26. A support assembly 50 is mounted in basin 10 for supporting a container, such as bottle 20 with the mouth 54 of the bottle facing downward. Basin 10 is filled with a cleaning solution 30 up to water line 21. Bottle 20 is positioned on the support so that mouth 54 remains above water line 21. When pump 13 is activated, cleaning solution 30 is drawn from basin 10 through drain channel 25 to the pump 13 where it is pressurized and sent through pressurizable channel 26 up to first tube 40 ending in nozzle 11. Nozzle 11 ejects the pressurized cleaning solution in the container so that the cleaning solution is distributed over the inner walls or an inside surface area 52 of the container. The cleaning solution drips down towards neck 56 and mouth 54 of bottle 20, thereby cleaning the inside surface 52 of bottle 20, and drips back into basin 10.

As shown in FIGS. 1-3, basin 10 is a rectangular tub elevated above a horizontal surface with legs 58 to allow room for plumbing assembly 32 below the basin bottom 60. The basin may be made out of any material suitable for holding a cleaning solution, for example stainless steel, plastic, etc. Basin 10 is filled with a cleaning solution up to a certain level marked by water line 21 so that the system is allowed to function. The amount of cleaning solution required for optimal performance will vary with the size of the system.

Support assembly 50 is mounted on basin 10 and is adapted to support an inverted container 20 with the container opening 254 above water line 21. The location of support assembly 50 allows cleaning solution 30 to drain back into basin 10. In the embodiment shown in FIG. 1, support assembly 50 is formed by a bracket 12 positioned in the center of the basin 10 with three legs 18 mounted on the bottom of basin 10. Bracket 12 may be concentric around tube 40 and may hold container 20, such as a carboy or a Cornelius keg upside down so that nozzle 11 is positioned internally to container 20. In other possible embodiments, brackets may be clipped to the sides of the basin for supporting a brew pail, for example. The support assembly is sized to support containers or bottles as they are commonly used in home brewing. The volume of containers used in home brewing typically ranges between 3 and 15 gallons. A common volume of a homebrewed batch of beer is typically around 5 gallons. However, the support assembly may be adapted to hold any size of container used in a home brewing process.

Basin 10 is provided with a drain 17 allowing cleaning solution to drain out of the basin. Drain 17 may be located at any suitable location in basin 10 where the drain does not interfere with the functioning of the system. For example, drain 17 may be a circular opening in the bottom 60 of basin 10 so that the cleaning solution gravitates into drain channel 25. Optionally, drain 17 may be provided with a closing mechanism or a filter. In some possible embodiment, the bottom of basin 10 may be sloped towards the drain opening to facilitate draining of the cleaning solution.

Drain channel 25 and pressurizable channel 26 may be formed by any type of suitable tubing material, for example, food grade flexible plastic tubes that are not affected by the cleaning solution. Drain channel 25 and pressurizable channel 26 are part of a plumbing assembly 32. Plumbing assembly 32 may further include one or more branches of tubes or channels depending on the embodiment. For example, as shown in FIGS. 1 and 2, pressurizable channel 26 leads to a first tube 40 extending through basin 10 upward above water line 21 into container 20. Channel 26 may also lead to a second tube 42 that extends into basin 10 and that is adapted for cleaning brewing accessories, for example brew tube 19. Tube 42 may end below waterline 21 in a tube washing barb 16 that releases pressurizable cleaning solution and facilitates coupling to brew tube 19, for example.

Plumbing assembly 32 further includes a pump 13 that interacts with channels 25 and 26. Pump 13 may be any type of commercially available pump that provides the desired amount of pressure and that is safe for handling food. For example, a magnetic drive pump may be used. These pumps require no seals or lubricants for operation and only plastic parts come in contact with the fluid. For example, a 700 gallon per minute drive pump that is submersible may be used in the system described above.

Cleaning solution is drawn from the basin 10 through a drain 17 to pump 13. Pressurized cleaning solution is directed via channel 26 and tube 40 to nozzle 11 and/or to tube barb 16. The flow to nozzle 11 is controlled by valve 14. The flow to the tube barb 16 is controlled by a valve 15.

Examples of suitable cleaning solutions are chlorinated water or water and automatic dishwasher soap. However, regular water or any other suitable sanitizing solution or cleaning agent may be used. The process may be repeated with different cleaning solutions in different steps. For example, in a first step a keg, its lid, and a siphon hose may be cleaned with chlorinated water. In a second step, soap may be used as a cleaning solution for cleaning brewing accessories.

FIG. 2 illustrates the relative positions of the bracket, nozzle and bottle of one embodiment of the system. Support 18 positions bracket 12 above water line 21. A beverage container, such as bottle 20, for example a carboy, is positioned in bracket 12 so that nozzle 11 is positioned in about the center of the inside of bottle 20 and the bottle is cleaned by the cleaning solution, for example chlorinated spray 22, emanating from the nozzle 11. The cleaning solution drips from the inside of the carboy through bracket 12 into basin 10.

The system and apparatus may further be used to clean tubes associated with home brewing. For example, a tube 19 may be attached manually to tube barb 16. When the system is activated, pressurized cleaning solution arrives from tube barb 16 into tube 19 thereby cleaning the inside of tube 19. Additionally, when submerging tube 19 in the cleaning solution, the outside of tube 19 will also be sanitized.

In another possible embodiment, the system and apparatus may be used to sanitize a Cornelius keg. Typically, an assembled Cornelius keg has at least one valve connected to an inner tube or pipe leading into the keg. The valve and inner tube are used to pressurize the fluid inside the Cornelius keg. The Cornelius keg further has an opening that is located next to the valve and that is covered with a top plate. The top plated is sealed with an O-ring. A handle usually presses the top plate against the O-ring and keg. When the keg is disassembled, the top plate is removed from the opening in the keg. FIG. 3 shows a Cornelius keg 200 as it is placed upside down on bracket 12 allowing tube 40 to extend into the body of the keg 200 through keg opening 254 and allowing the shoulders of keg 200 to rest on bracket 12. Top plate 61 of keg 200 may be stored submerged in cleaning solution 30 in basin 10. Keg 200 further has a valve 260 connected to inner tube 202. In addition to the sanitation provided by the use of tube 40 as described above, keg 200 and inner tube 202 may be sanitized by connecting valve 260 to the system. Valve 260 may be connected to an extension tube of tube barb 16, for example by using an extension tube 204 as is commonly used in the home brewing process. Tube 204 has one end coupled to tube barb 16 and another end coupled to valve 260. When the system is activated, pressurized cleaning solution is sent through valve 260 into inner tube 202 thereby cleaning valve 260 and the inside of inner tube 202. Cleaning solution may emanate from the end 211 of inner tube 202 and provide additional cleaning solution to the inside of keg 200. The system may be activated, for example, by switching pump 13 on and opening valve 15 thereby pumping cleaning solution from basin 10 through tube 42 into inner tube 202. Additionally, valve 14 may be opened to clean the inside of keg 200 as described above. The cleaning solution will drain back into basin 10 through keg opening 254.

In the embodiments shown in FIGS. 1-3, the dimensions of the basin are approximately 15.5" by 15.5" at the base and the sides are approximately 16" high. Bracket 12 is approximately 5" in diameter and 4" high. The base of bracket 12 is mounted on three legs 18 which suspend the bottom of the bracket at a level approximate to the level of the top of the basin. The nozzle protrudes approximately 8" beyond the upper rim of the bracket. In the embodiment illustrated in FIG. 2, water line 21 comes to within an inch of the top of the basin 10. In one possible embodiment, a vertical tube with a spray nozzle attachment protrudes 13" above the water line of the basin. The tube is positioned in the middle of the basin. These dimensions are for illustrative purposes only and the dimensions and overall size of the apparatus may vary.

In some embodiments, basin 10 may be adapted to support larger containers in an upside down position. Some large containers, for example buckets, do not have shoulders and bottle neck. These types of containers may be supported in the basin by hooks or brackets hanging from the sides of the basin and supporting the rims of the bucket above the cleaning solution. For example, in the embodiments shown in FIGS. 1-3 four hooks may be attached to the outer rim on each side of the basin to accommodate brew pails.

In some possible embodiments, plumbing assembly 32 may include a valve for regulating the flow of cleaning solution 30. Both nozzle 11 and the tube barb 16 may be controlled by manually operated valves, for example valves 14 and 15. In other embodiments, additional operating mechanisms may be added.

Optionally, basin 10 may be used to store other accoutrements used in brewing such as funnels, bubblers, thermometers, strainers, etc. These items may be submerged in the basin to maintain sterility until needed. The basin may also be used, without cleaning solution, for drying and storing these items.

In some embodiments such as for home brewing beer, the sanitizing method may be used to first sterilize a keg, its lid, and a siphon hose. Subsequently, beer may be transferred from a carboy into the sanitized keg. The used carboy and brewing equipment could then be cleaned in a second cleaning step. After cleaning the carboy, the basin may be emptied and the equipment allowed to dry.

The inventive subject matter further contemplates a basin for sanitizing home brewing equipment and a system for using such a basin. In this embodiment, a submersible pump is positioned directly in the cleaning solution in the basin instead of below the basin, as described in the embodiments above, thereby eliminating the need for connecting tubes and regulating valves. The basin may be formed as a one-piece structure, for example, as a one-piece molded design. Such a one-piece structure is easy to sanitize, lightweight, and does not leak. Moreover, such a basin is easy to assemble/disassemble because few additional parts are needed to use the keg washer.

The basin includes an open chamber to hold a solution and a raised platform sized and configured to support a container in an upside down position above the solution. Additionally, the basin can be used to sanitize anything that touches the beer such as vessels, hoses, strainers, thermometers, etc.

The basin has a footprint of support elements adapted to support at least two different sizes of containers. For example, the shape of the basin may be curved along the platform on one side of the basin to complement the shape of a brew pail, such as a large 7 gallon pail. To hold the pail in position during use, the basin may have a curved rim extending along the platform. Furthermore, the platform may have additional support elements protruding from the rim along the platform and concentric with the outer support elements to accommodate smaller sizes of pails. Additional support elements may be positioned in the chamber or extending from the sides of the chamber. In some embodiments, the basin may be shaped to complement a brew pail on all sides. In other embodiments, the overall diameter of the basin may be reduced to clean smaller containers, such as a carboy. In some embodiments, the support elements define footprints that are concentric with one another.

The platform is further configured to accommodate a pump. For example, the platform may have a cutout to house a submersible pump so that, when the pump is activated, solution enters the pump from the chamber and pressurized solution is released from the pump into the container. A pump outlet channel may be positioned centrally to the support elements.

Cleaning solution that exits the container drains back into the basin. In some embodiments, the platform may be slanted towards the chamber of the basin so that cleaning solution flows into the basin. In other embodiments, the entire basin may be positioned at an angle with the chamber at the lowest point. Optionally, support elements may be configured to hold the container in a suitable position.

In some embodiments, the chamber of the basin is dimensioned to allow a user access to the solution during the cleaning process, for example to remove/add solution or the add substances to the solution.

Figure 4:
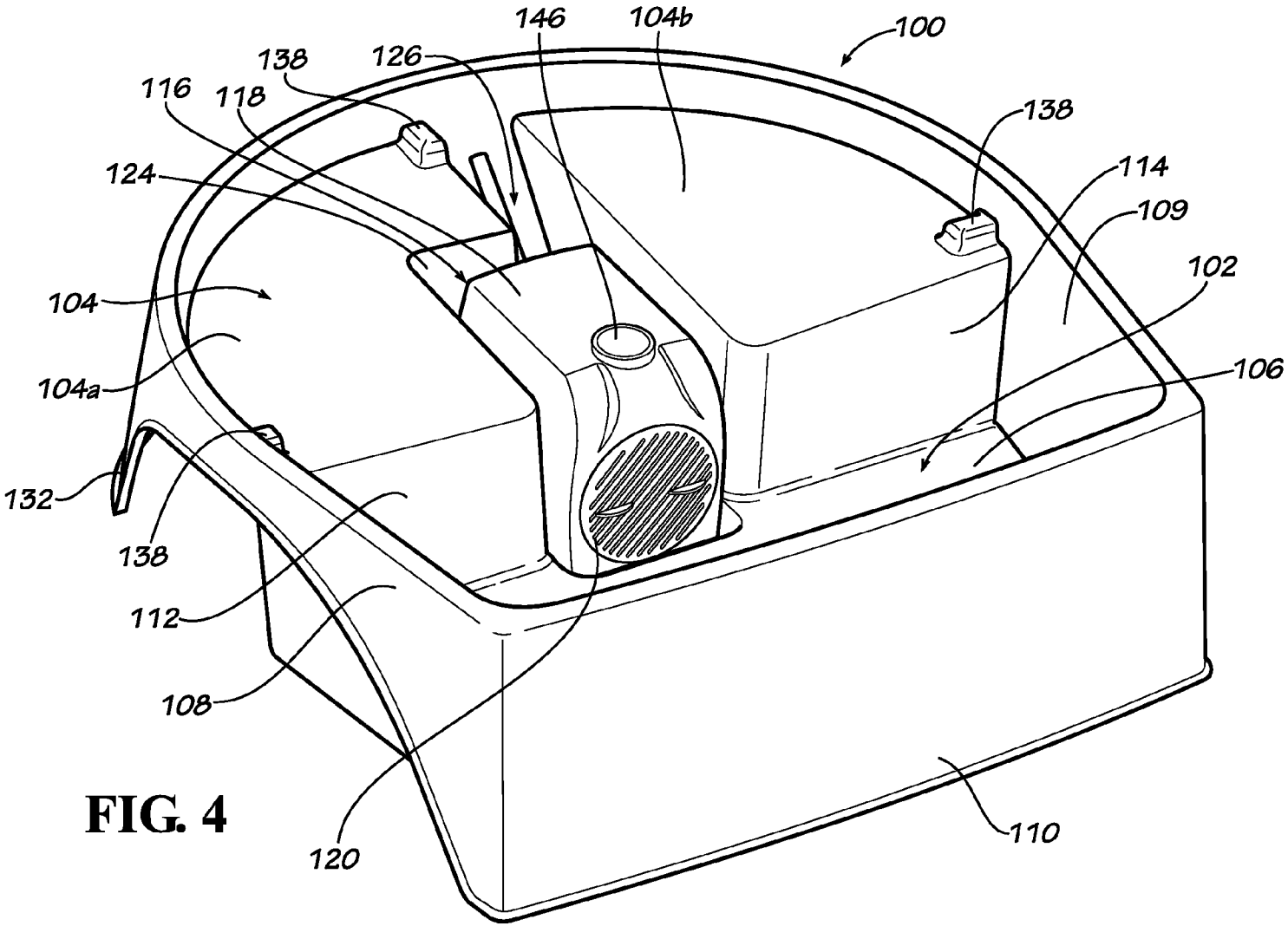
FIG. 4 is a perspective view of a basin with a pump.

FIG. 4 shows a basin 100 with a chamber 102 and a platform 104. Chamber 102 is formed as an open area having a bottom surface 106 and sidewalls 108, 109, 110, 112 and 114. Three of the four sides of the chamber are formed by outer side walls 108, 109, and 110 of basin 100. A fourth side wall of the chamber is formed by walls 112 and 114 extending upward from bottom surface 106 to platform 104. Between wall 112 and 114 a cutout 116 in platform 104 houses a pump 118. Cutout 116 splits platform 104 in two portions 104*a* and 104*b*. Pump 118 is positioned in cutout 116 so that the intake side 120 of pump 118 faces chamber 102 and complements walls 112 and 114 to form a fourth side wall of chamber 102. Pump outlet channel 146 may be positioned centrally in basin 100. Cutout 116 is shaped to complement pump 118 so that the pump is hugged securely along its sides during use. Additionally, bottom surface 106 may be recessed below pump 118 to prevent pump 118 from moving forward into chamber 102 during use. Backward movement of pump 118 may be prevented by wall 124 of cutout 116 which faces backside 122 of pump 118. In some embodiments, wall 124 may enclose backside 122 of pump 118, for example for basins to be used with battery operated pumps. In other embodiments, for example as shown in FIG. 4, wherein an electric pump 118 is used, a channel 126 extends from wall 124 of cutout 116 to the edge of basin 100 allowing an electric cable to run from pump 118 over rim 128 of the basin 100 to an electric outlet without interfering with the stability of the container. Optionally, a drain may be provided in the bottom surface of basin 100.

Figure 5:
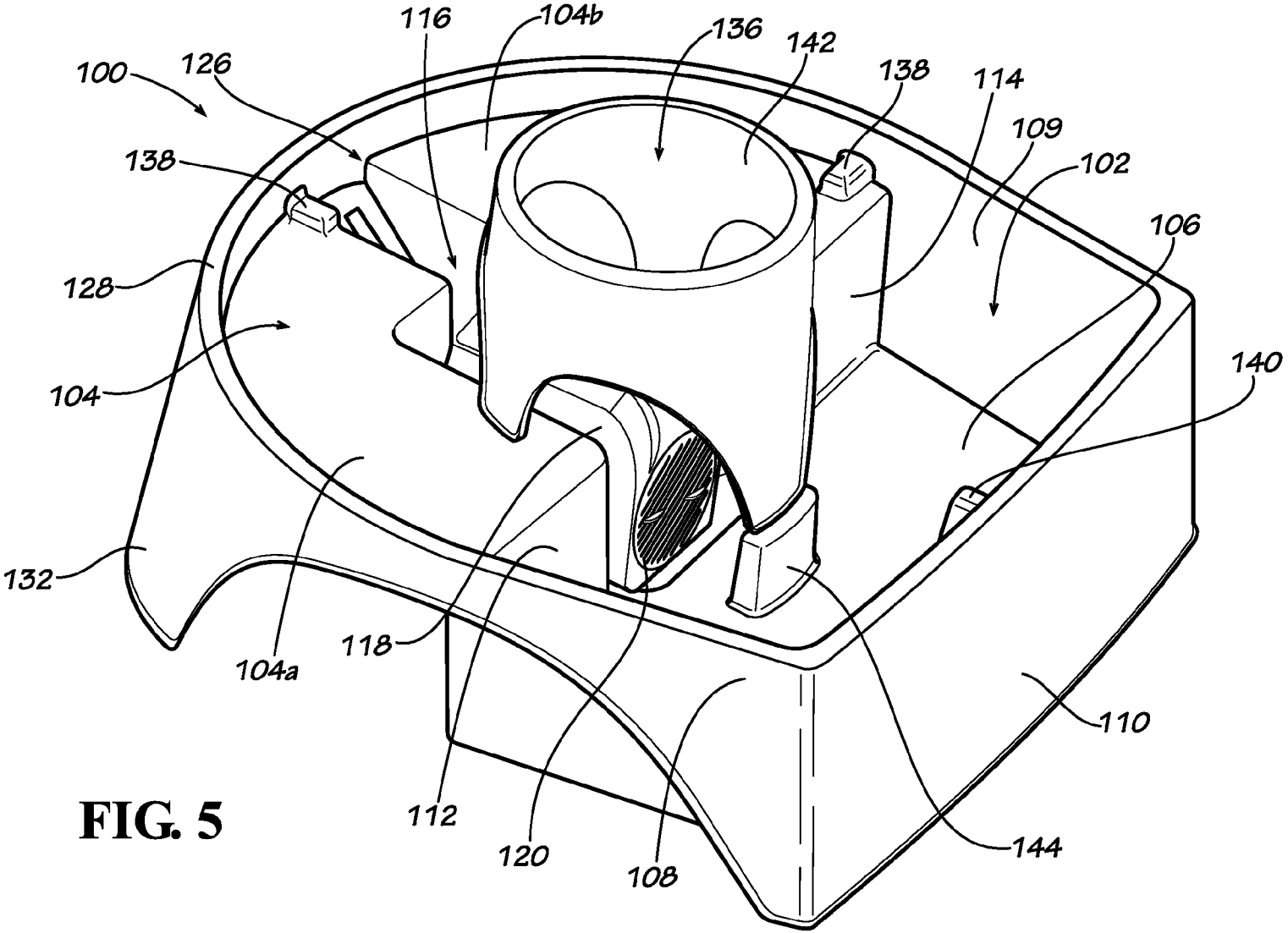
FIG. 5 is a perspective view of a basin, pump, and support rack.
Figure 6:
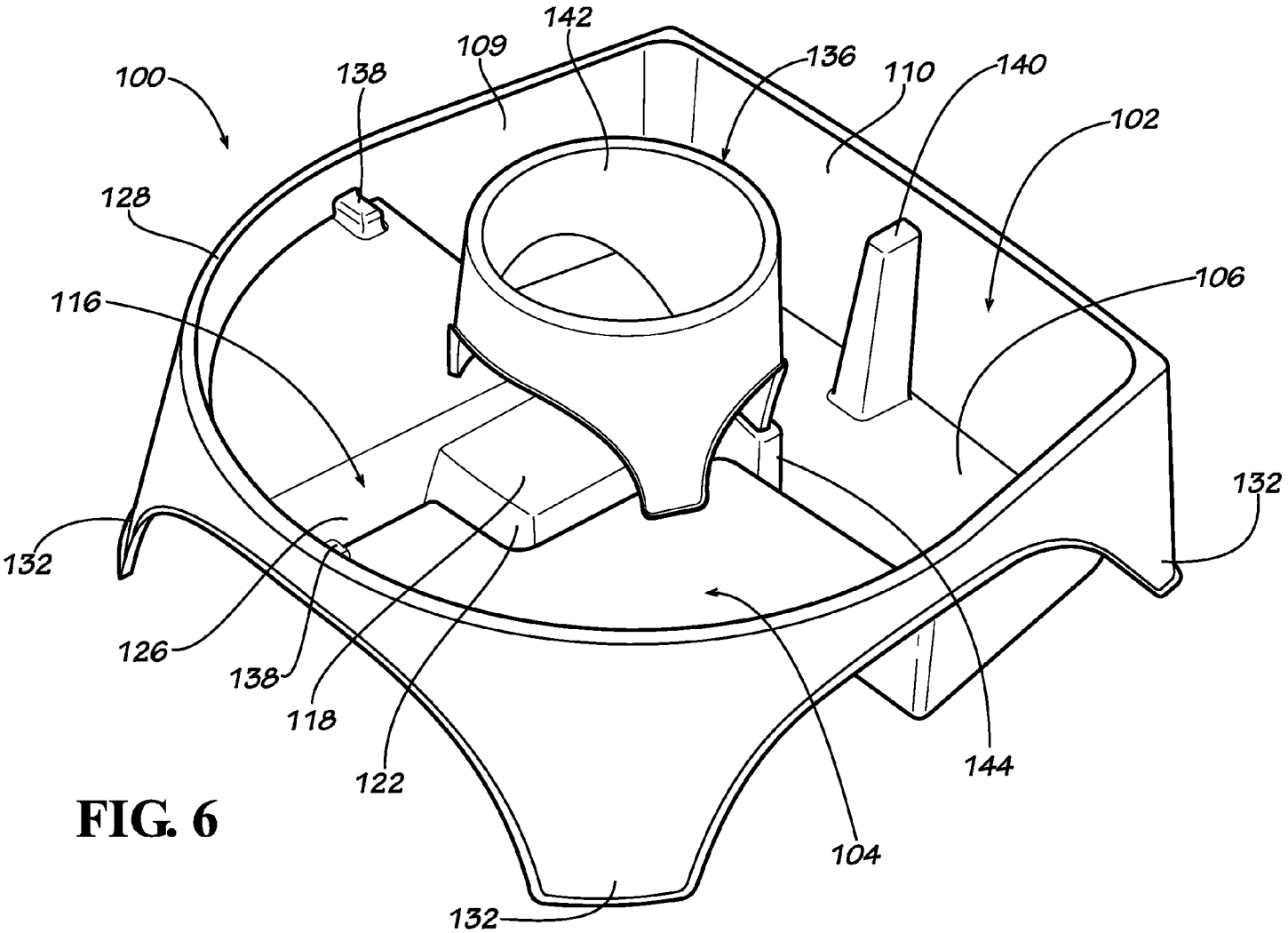
FIG. 6 is another perspective view of the embodiment of FIG. 5.

As shown in FIGS. 4-6, the contours of basin 100 have a shape similar to a D when viewed from the top. The D-shaped basin is formed by chamber 102 having a generally rectangular shape and platform 104 having a semicircular shape. In other embodiments, the basin may have a different shape. For example, the chamber may be configured to have a square, semicircular, or any other suitable shape.

FIGS. 4-6 show a basin 100 with double walled sides. Outer walls of basin 100 may extend outwardly down from rim 128 to form support structures for the basin, for example, support legs 132 and front wall 110 may provide a sturdy base on a horizontal work surface. In some embodiments, outer walls 128 may be configured to interact with a work surface, such as a sink for example. Basin 100 further has one or more footprints of support elements to hold different sizes of containers upside down with the opening above the cleaning solution. One footprint may be concentric with another footprint. A first diameter of the footprint may be formed by the outer perimeter of the basin, for example as indicated by rim 128. This area defines a first diameter of a container that the basin is capable of supporting. Within the perimeter of the rim and concentric within the first footprint may be a second footprint of additional support elements that define diameters of smaller sized containers. These footprints may be concentric around pump outlet channel 146. In some embodiments, protrusions 138 may extend radially from the rim 128 towards the inside of the basin. In other embodiments, protrusions 138 allow positioning of a container on the platform so that the edge of the container is held by protrusions 138 with the nozzle in the center and supported by the platform and/or protrusions. Optionally, the inside of front wall 110 along chamber 102 may have protrusions to support a container, for example, a protrusion 140 extending from the side below rim 128, as shown in FIGS. 5-6. In some embodiments, support elements may have stepped portions or otherwise incrementally decreasing/increasing portions to accommodate different sizes of containers. In other embodiments, support elements may have slanted or gradually decreasing/increasing surfaces to hold different sizes of containers.

FIGS. 5-6 show another embodiment of a basin 100 wherein a first footprint defines an area for holding different sizes of larger containers with straight sides, for example of a bucket type, and a second footprint, defined a support assembly 136 mounted within the perimeter of the first assembly, provides support areas for holding containers of the bottle type. For example, a second footprint for holding containers may be provided by a support assembly formed by a removable support rack 142 that is positioned in the center of basin 100, as shown in FIGS. 4-5. Support rack 142 is adapted to hold, a bottle type container upside down by supporting the shoulders of the bottle and holding the mouth of the bottle above the cleaning solution. The rack may be configured to support different sizes of bottles. For example, support elements similarly as those described above may be provided along the inside of a cone-shaped rack. In other embodiments, the rack may have slanted or stepped surfaces to hold the shoulders and mouth of a bottle. In the embodiment shown, rack 142 has three legs, two of which rest on platform 104 and one resting on a base 144 in chamber 102. In other embodiments, rack 142 may have different configurations, such as four legs. Optionally, a rack may be integrated with the basin. In the embodiments shown, rack 142 is a distinct element separate from basin 100. However, in other embodiments, rack 142 may be integrated with basin 100 to form a one-piece structure. In the embodiments shown in FIGS. 4-6, pump 118 is a submersible type pump. These pumps have a hermetically sealed motor close-coupled to the pump body. The whole assembly is submerged in the fluid to be pumped. Examples of submersible pumps that may be are suitable for these embodiments are pumps such as commonly used in applications for drainage, sewage pumping, general industrial pumping and slurry pumping. One example of a suitable pump is aquarium pump such as the fountain pump offered for sale by Danner Manufacturing, Islandia, N.Y.

Pump outlet channel 146 may be coupled to a channel extending into the container, such as tube 40 ending with nozzle 11 shown in FIGS. 1-3. This tube may be coupled to pump outlet channel 146 by, for example, by a snap fit coupling or threaded fasteners or any other suitable coupling means and extend vertically into the container.

The inventive subject matter further contemplates a method for cleaning of home brewing equipment by using the systems described above. For example, the following steps may be used in the cleaning process. First, a pump is installed in the basin. Then, cleaning solution is added to the chamber of the basin up to a level so that the pump inlet is submerged. Subsequently, a channel or tube is coupled to the pump outlet and a container is positioned on the basin so that the tube extends in the container. The pump may be activated by a switch or by plugging directly into an electric outlet. When the pump is activated, solution is pumped from chamber 102 into the channel so that the nozzle at the end of the channel releases pressurized solution against the inner walls of the container. The solution drains back into the basin thereby cleaning the inner walls of the container. Any cleaning solution on the platform drains into the chamber. The solution may be scooped out of the chamber, for example by a small cup and/or cleaning solution may be added to the chamber. After use and disassembly, the basin may be emptied and dried. The method for cleaning equipment may be repeated, for example for cleaning a container of a different size.

A basin according to the inventive subject matter may be made a material that is highly chemically resistant and stain-proof, for example a food-grade plastic material. The basin may be made by suitable molding techniques, such as injection molding, compression molding, thermoforming, etc.

In the embodiments shown in FIGS. 4-6, the dimensions of the basin are approximately 15.5" by 15.5" at the base and the sides are approximately 12" high. Support rack 142 is approximately 5" in diameter and 4" high. The nozzle protrudes approximately 8" beyond the upper rim of the support rack. These dimensions are for illustrative purposes only and the dimensions and overall size of the apparatus may vary.

The inventive subject matter further contemplates a kit including a basin, a support assembly, and a pressurizable channel. In some embodiments, the kit may also include a submersible pump.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

The invention claimed is:

1. A basin for sanitizing containers comprising:

a submersible pump and a chamber for holding a solution, wherein the chamber defines a bottom surface;

a raised platform formed from a raised portion of the bottom surface and being sized and configured to support a container in an upside down position above the solution, and the platform is configured to house the submersible pump so that, upon activation of the pump, solution enters the pump from the chamber and pressurized solution will be released from the pump into a channel extending into the container so that the inside of the container will be sanitized and solution drains back into the chamber of the basin via a container opening;

wherein the chamber is configured to allow direct access by a user to the solution during use of the basin;

wherein the basin comprises support elements defining footprints for supporting at least two different sizes of containers; and wherein one footprint is within the perimeter of the other footprint.

2. The basin of claim 1 wherein one footprint is concentric to the other footprint.

3. The basin of claim 1 wherein the footprints are concentric to a pump outlet channel.

4. The basin of claim 1 wherein the support elements define a first footprint having a diameter for supporting a larger size container; and within the perimeter of the first footprint support elements that define a second footprint having a diameter for supporting smaller sized containers.

5. The basin of claim 1 wherein the basin comprises a first footprint for supporting different sizes of containers and further comprises a second footprint within the perimeter of the first footprint for supporting bottle type containers.

6. The basin of claim 1 wherein support elements are configured to support a container having a volume ranging between approximately 3 and 15 gallons.

7. A system for sanitizing containers comprising:

a submersible pump;

a basin comprising an open chamber defining a floor and configured to hold a solution;

a raised portion of the floor defining a platform sized and configured to support a container in an upside down position and above the solution;

the platform having a recess configured to house the submersible pump so that, upon activation, solution enters the pump from the chamber and pressurized solution will be released from the pump into the container so that he inside of the container will be sanitized and solution drains back into the chamber of the basin via a container opening;

wherein the chamber is configured to allow direct access by a user to the solution during use of the basin;

wherein the basin comprises support elements defining a first footprint adapted to support at least two different sizes of containers;

a support assembly mountable within the perimeter of the first footprint, the support assembly comprising a second footprint defined by support elements for supporting a bottle type container in an upside down position and above the solution; and wherein pressurized solution will be released from the pump into to a pressurizable channel configured to extend into the body of the container.

8. The system of claim 7 wherein footprints are adapted to support containers having a volume ranging between approximately 3 and 15 gallons.

9. A basin according to claim 1, wherein a wall extends upwardly from the bottom surface to the raised platform.

10. A basin according to claim 9, wherein the platform comprises a first platform portion and a second platform portion spaced apart from the first platform portion by a recessed region defining a gap, wherein the upwardly extending wall comprises a first wall portion and a second wall portion spaced apart from the first wall portion.

11. A basin according to claim 10, wherein the gap is sized to receive the submersible pump such that the platform is configured to house the submersible pump.

12. A basin according to claim 10, wherein one or both of the first and the second platform portions defines one or more of the support elements.

13. A basin according to claim 1, wherein the raised platform so defines a recessed region as to define a first platform portion spaced apart from a second platform portions.

14. A system according to claim 7, wherein a wall extends between and adjoins the floor of the chamber and the raised platform.

15. A system according to claim 14, wherein the raised platform defines a recessed region to form a gap between a first platform portion and a second platform portion.

16. A system according to claim 15, wherein the recessed region defined by the raised platform is sized to receive a submersible pump.

17. A system according to claim 15, wherein the raised portion of the floor defining a platform comprises a first raised portion of the floor defining a corresponding first platform portion and a second raised portion of the floor defining a corresponding second platform portion, wherein the first platform portion and the second platform portion are spaced apart from each other to define the recess.

* * * * *